US006241464B1

(12) United States Patent
Huffaker et al.

(10) Patent No.: US 6,241,464 B1
(45) Date of Patent: Jun. 5, 2001

(54) GOVERNOR MECHANISM FOR A ROTARY DEVICE

(75) Inventors: David E. Huffaker, Lancaster; Frank D. Lehman, Wilson, both of NY (US)

(73) Assignee: Dynabrade, Inc., Clarence, NY (US)

( * ) Notice: Subject to any disclaimer, the term of this patent is extended or adjusted under 35 U.S.C. 154(b) by 0 days.

(21) Appl. No.: 09/419,567

(22) Filed: Oct. 18, 1999

(51) Int. Cl.[7] ..... F01D 17/00

(52) U.S. Cl. ..... 415/25; 415/36; 415/904

(58) Field of Search ..... 415/82, 80, 30, 415/36, 26, 44, 49, 47, 151, 156, 159, 904; 137/50, 47

(56) References Cited

U.S. PATENT DOCUMENTS

| | | | |
|---|---|---|---|
| 444,938 | 1/1891 | Kinkaid . | |
| 3,733,143 | 5/1973 | Theis, Jr. | 415/80 |
| 4,087,198 | 5/1978 | Theis, Jr. | 415/82 |
| 4,776,752 | 10/1988 | Davis | 415/25 |
| 5,496,173 | 3/1996 | Wohlgemuth | 433/132 |
| 5,567,154 | 10/1996 | Wohlgemuth | 433/132 |

FOREIGN PATENT DOCUMENTS

| | | | |
|---|---|---|---|
| 2275971 | 9/1994 | (GB) | F01D/1/3215 |
| WO 88/06676 | 9/1988 | (WO) . | |

*Primary Examiner*—Edward K. Look
*Assistant Examiner*—James M. McAleenan
(74) *Attorney, Agent, or Firm*—Simpson, Simpson & Snyder, L.L.P.

(57) ABSTRACT

A governor mechanism is mounted for rotation with a drive shaft about an axis, has one or more reaction nozzles for imparting rotational movement to the drive shaft, and one or more valve portions supported for radially directed sliding movement between first and second radially spaced positions for purposes of controlling flow of pressurized fluid to the nozzles and thus the rotational speed of the drive shaft. The valve portions are formed integrally with a ring-shaped mounting portion fabricated from resiliently deformable material. In alternative constructions, similar governor mechanisms are co-axially mounted with vane motors by a common drive shaft and the mechanisms employed to control flow of pressurized fluid to the vane motor.

15 Claims, 5 Drawing Sheets

GOVERNOR MECHANISM FOR A ROTARY DEVICE

BACKGROUND OF THE INVENTION

The present invention generally relates to a governor mechanism for controlling the rotational speed of a rotary device by a centrifugally operated valve means adapted to vary flow of pressurized fluid passing through the governor mechanism. Representation of prior art relating to this general type of mechanism include U.S. Pat. Nos. 444,938; 3,733,143; 4,087,198; 4,776,752; 5,496,173; and 5,567,154.

SUMMARY OF THE INVENTION

The present invention relates to a governor mechanism adapted in the first instance for use in effecting rotation of a drive shaft in response to the discharge of pressurized fluid from the mechanism through one or more reaction nozzles, wherein flow of fluid to the nozzles is controlled by a resiliently deformable member having at least one valve portion carried by a ring-shaped mounting portion and supported by a guide for radially directed sliding movements in response to changes in the rotational speed of the drive shaft.

In alternative embodiments, the governor is co-axially mounted on a drive shaft with a fluid operated, vane-type drive motor, and the resiliently deformable member is employed to control the flow of pressurized fluid employed to operate the motor.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
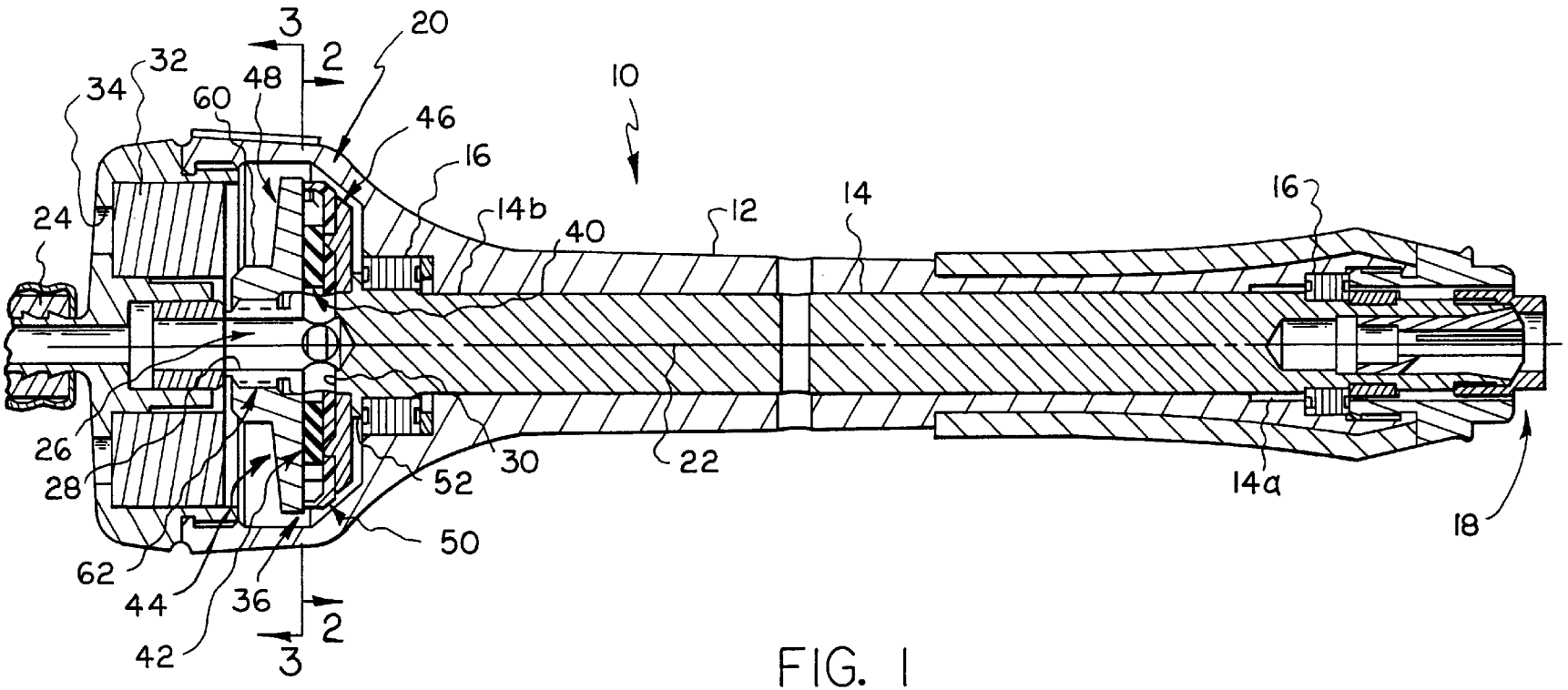
FIG. 1 is a partial sectional view taken lengthwise through a rotary grinder device incorporating a governor mechanism of the present invention.

Reference is first made to FIG. 1, wherein a rotary grinder device is generally designated as 10 and shown for purposes of illustration as including an elongated, hand manipulated housing 12 enclosing an elongated drive shaft 14 supported therein by bearings 16,16 and having a first end 14*a* coupled to a chuck collet 18 for mounting a suitable tool, not shown, and a second end 14*b* coupled to a turbine device 20, which serves to drive the shaft for rotation about its axis 22 in response to the supply of a fluid, such as air, under pressure to the turbine device from a suitable source, also not shown, via a suitable hose or tube 24 and a flow path 26 defined by communicating axially and radially extending openings 28 and 30 formed in the second end of the shaft. Typically, device would be fitted with a muffler 32 to reduce the noise of fluid passing from turbine device to the atmosphere via housing exhaust openings 34.

In accordance with a presently preferred form of the present invention, turbine device 20 is designed to function as a governor mechanism serving to control the flow of fluid therethrough in order to limit the rotational speed of shaft 14.

The present governor mechanism is best shown in FIGS. 1–5 as generally including a first member 36, which serves to define discharge openings 38 shaped to define reaction nozzles through which pressurized fluid is expelled tangentially of shaft 14 for purposes of imparting rotation to the shaft and a passageway 40 serving to place the nozzles in flow communication with flow path 26, and a second member 42, which is resiliently deformable in response to change in the rotational speed of the shaft for purposes of varying the flow of fluid to the nozzles in order to limit the rotational speed of the shaft.

More specifically, first member 36 is of multi-part construction including a housing 44 defined by first and second outer end parts 46 and 48 and a third part 50 sandwiched therebetween.

First end or turbine base part 46 is of washer-shaped configuration sized to slidably receive shaft end 14*b*, arranged to axially abut against a radially extending enlargement or abutment 52 carried by the shaft, and formed with an annular mounting member or flange 54 adapted to radially position or locate third part 50 concentrically of axis 22, as best shown in FIGS. 1, 2, 4 and 5.

Second or top plate part 48 is generally of washer-shaped configuration having locating notches 58,58 for use in keying third part 50 for rotation therewith and an enlarged hub 60 threadably engaged with shaft second end 14*b*, as at 62, for purposes of cooperating with abutment 52 to releasably clamp the third part axially between and in surface-to-surface engagement with first and second parts 46 and 48.

Figure 2:
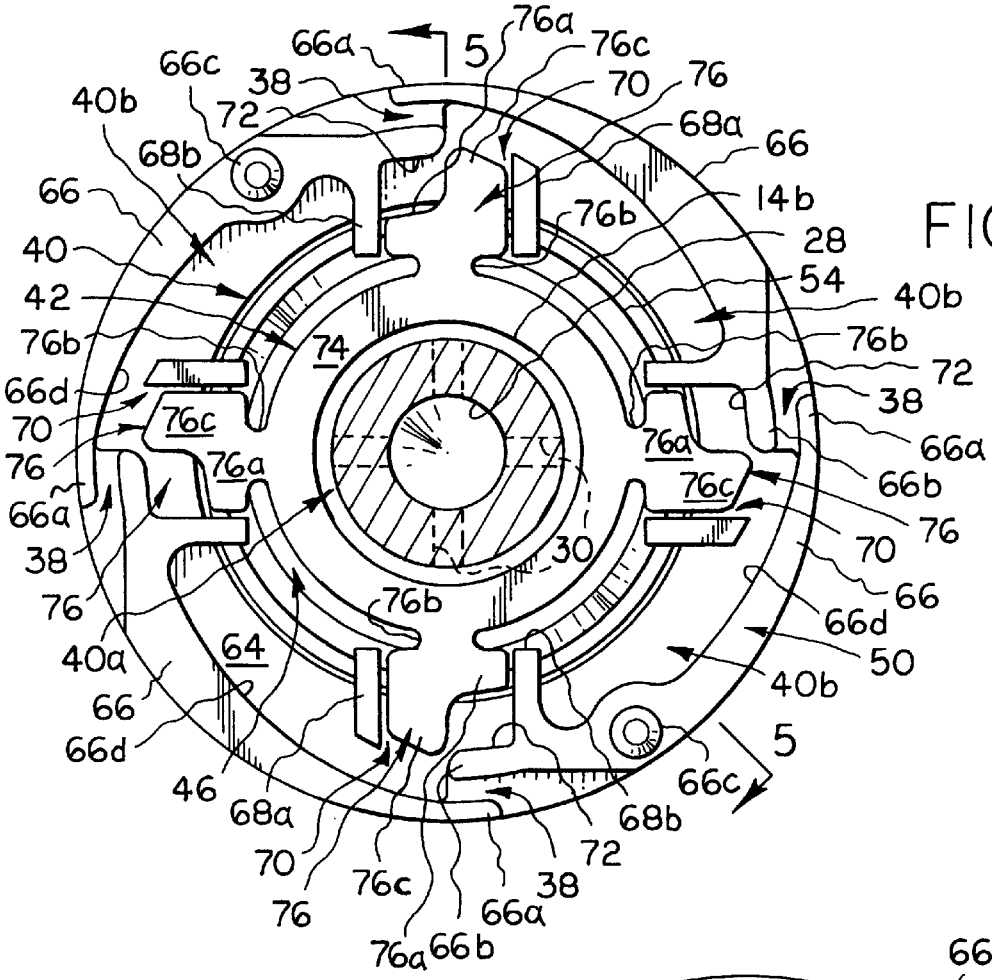
FIG. 2 is an enlarged view taken generally along the line 2—2 in FIG. 1.
Figure 3:
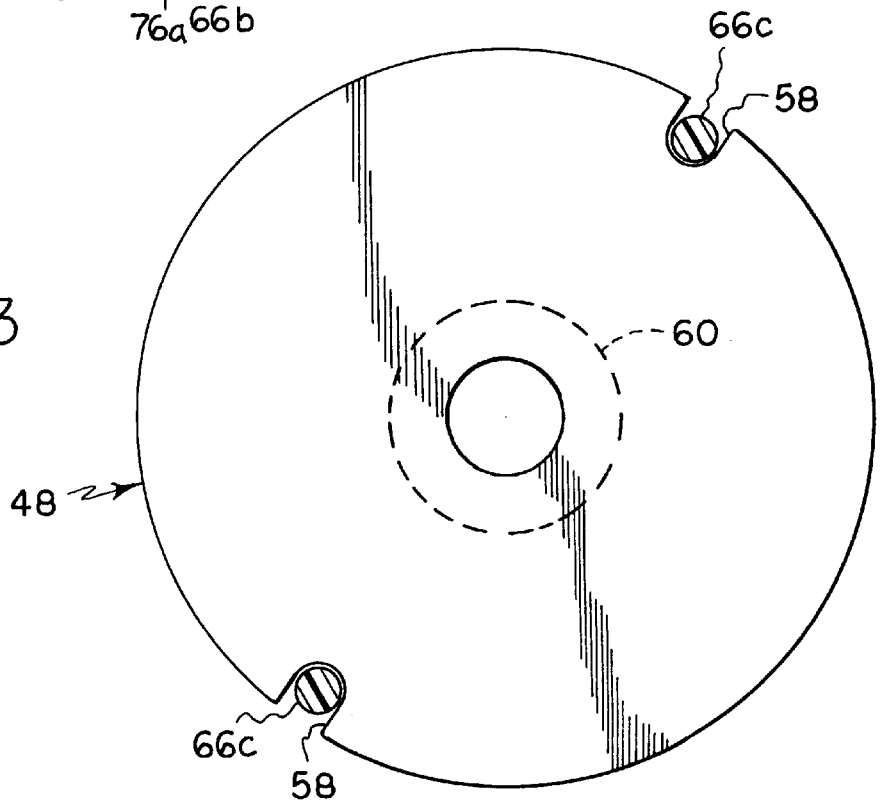
FIG. 3 is an enlarged sectional view taken generally along the line 3—3 in FIG. 1.

Third or turbine part 50 is of generally ring-shaped configuration having a planar portion 64 from which upstands a plurality of annularly extending boundary ribs 66 having their adjacent free ends 66*a* and 66*b* arranged to overlap one another, so as to radially bound nozzles 38, and a plurality of pairs of parallel guide ribs 68*a* and 68*b*, which cooperate to define guideways 70 arranged to extend radially of axis 22. Free ends 66*b* may additionally serve to define radially inwardly facing stops 72, which partially extend across the radially outer ends of guideways 70, as best shown in FIGS. 2 and 3. An opposed pair of boundary ribs 66,66 are formed with axial projections 66*c*,66*c* which are arranged for receipt within notches 58,58 for purposes of keying third part 50 for rotation with second part 48.

In the illustrated construction, parts 46, 48 and 50 cooperate to define passageway 40. More specifically, passageway 40 includes an annular inner part 40*a*, which communicates with radially extending openings 30 and is axially bounded by facing surfaces of outer end parts 46 and 48; and an outer part or parts 40*b*, which communicate one with each of nozzles 38 and inner part 40*a*, and are axially bounded by facing surfaces of planar portion 64 of part 50 and part 48.

Second member 42 is best shown in FIGS. 1, 2, 3 and 4 as including a ring-shaped mounting portion 74, which carries a plurality of valve portions 76 arranged to extend radially of axis 22. Each of valve portions 76 includes a radially inner part 76*a*, which is arranged to be slidably received within one of guideways 70 and be connected to mounting portion 74 by a narrow connecting web 76*b*, and a radially outer part 76*c* arranged to be moved towards and away from an inwardly facing surface 66*d* of an associated boundary rib 66 for purposes controlling flow through an outer passageway part 40*b* towards one of nozzles 38.

Figure 4:
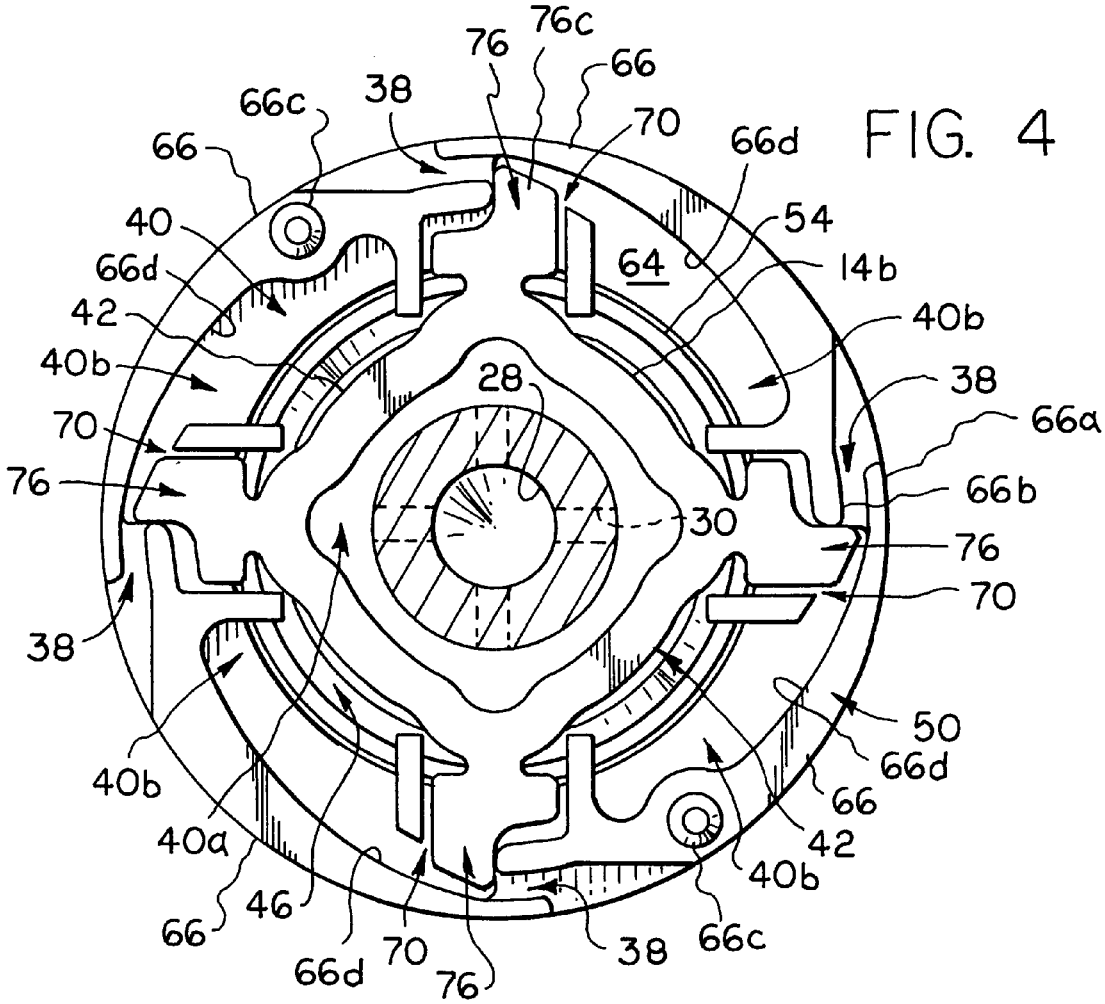
FIG. 4 is a view similar to FIG. 3, but showing the second member of the mechanism deformed in response to the rotational speed of the mechanism.
Figure 5:
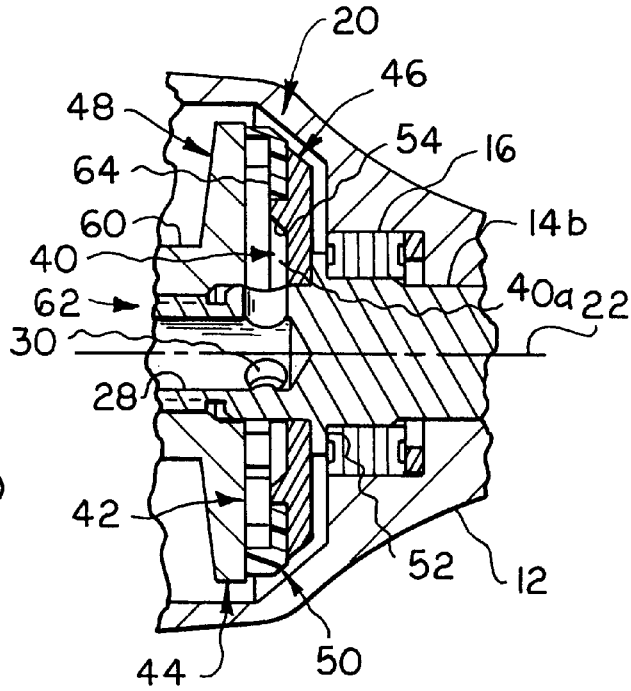
FIG. 5 is a reduced size sectional view taken generally along the line 5—5 in FIG. 2.

It will be understood that second member 42 is formed from a resiliently deformable or elastic material biased to normally assume a first or as formed configuration shown in FIG. 2 when shaft 14 and first member 36 are subject to a some given first rotational speed, such as zero. In this first configuration, outer part 76*c* of each valve portion 76 assumes a first radial position relative to an associated outer passageway part 40*b*, whereby to permit some given maximum rate of flow of fluid towards an associated nozzle 38. As the rotational speed of shaft 14 and, thus, first member 36 increases, second member 42 due by subject to progressively increasing degrees of resilient deformation until the second member reaches some given second configuration, such as that shown in FIG. 4, wherein outer part 76*c* of each valve portion 76 assumes a second radial position relative to its associated outer passageway part 40*b*, whereby to reduce flow of fluid towards nozzles 38 to some minimum valve. In operation, the high initial fluid flow rate serves to initiate rotation of the drive shaft 14 and the final reduced fluid flow rate serves to limit or define a desired maximum operational rotational speed of the drive shaft. Subsequently, during the use, an increase in load to which the tool is subjected will cause a reduction in the rotational speed of the tool. Any such reduction in speed will cause valve portions 76 to move towards their first positions, whereby permitting an increase in flow through nozzles 38. It is to be noted that, while all portions of second member 42 become stressed dye to resilient deformation incident to change in rotational speed between conditions depicted in FIGS. 2 and 4, the maximum stress and degree of resilient deformation occurs in mounting portion 74, as generally shown in FIG. 4. Preferably, second member is shaped and formed from a resiliently deformable material, such as a nitrile elastomer, chosen to allow its second configuration to be determined by a balancing of the combination of elastic forces acting on the second member and dynamic forces resulting from the flow of pressure past the outer ends of valve portions 76 against the centrifugal force acting on the second member. Alternatively, the second configuration may be determined by positioning stops 72 for motion limiting abutting engagement by outer end parts 76*c* of valve portions 76.

While a preferred construction employs four guideways 70 and slidably associated valve portions 76 spaced annularly of axis 22 through approximately 90° from one another, it is contemplated that these may be replaced by a pair of radially aligned guideways and valve portions spaced annularly of the axis through 180°, or by only a single guideway and associated valve portion when same is provided in combination with a suitable radially aligned weight spaced therefrom annularly through 180°. In like manner, the number of nozzles 38 may be varied, if desired, to correspond to the number of guideways and valve portions.

Figure 6:
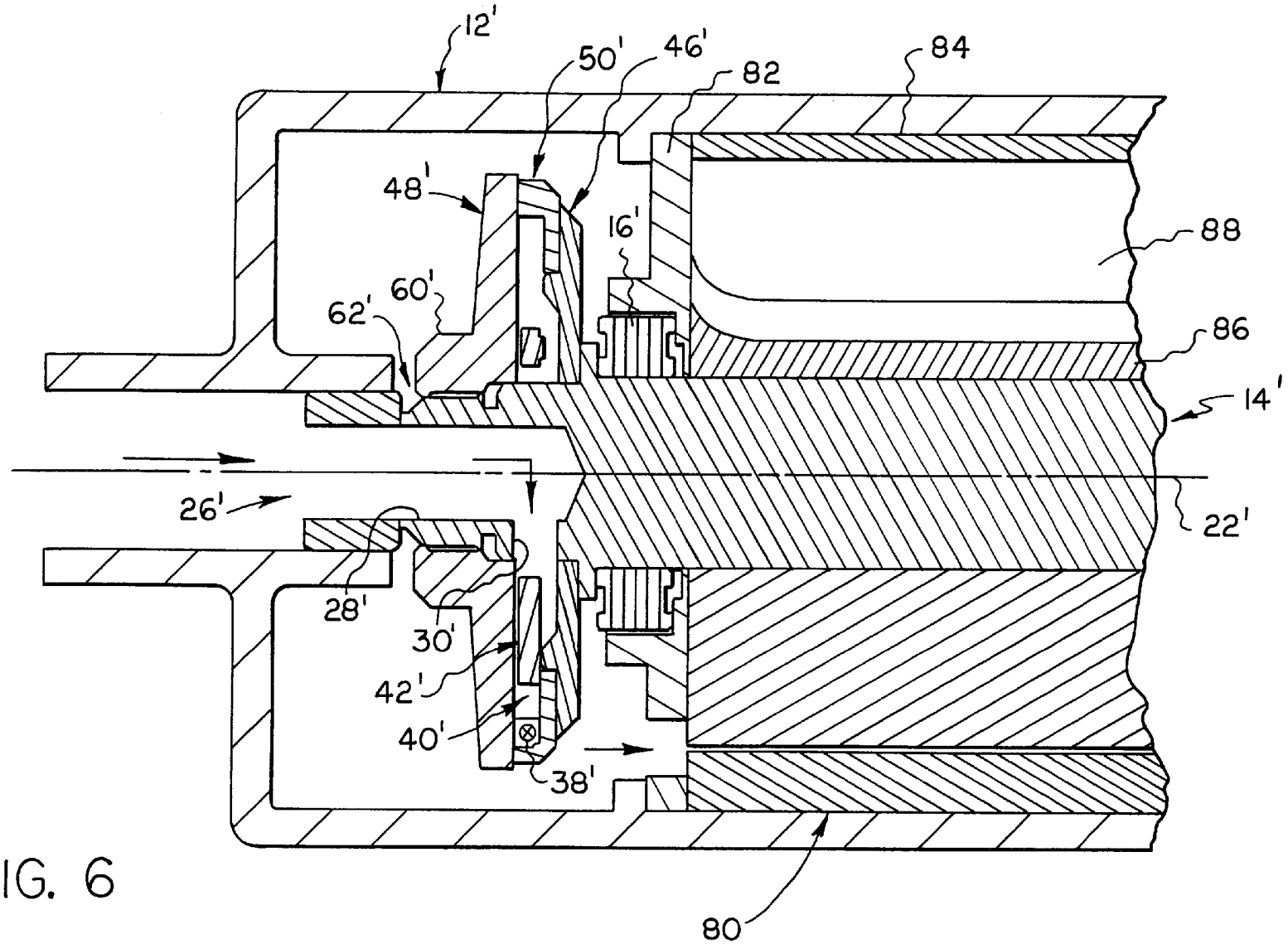
FIG. 6 is a partial sectional view taken lengthwise through a rotary device of alternative construction.

FIG. 6 depicts an alternative form of the present invention, wherein like parts are designated by like primed numbers. More specifically, this form of the invention differs from that described above primarily in that the discharge opening(s) 38' need not be shaped and sized to define efficient propulsion nozzle(s) per se, but rather merely to provide for the efficient flow of pressurized fluid to drive a vane motor 80 mounted coaxially with the governor mechanism on shaft 14'. Motor 80 may be of the general type conventionally employed to drive hand held, pneumatically operated tools, such as rotary grinders and sanders, and thus same is only partially shown and described as including a motor end plate 82 and motor cylinder 84 carried by housing 12' and a rotor 86 and vanes 88 carried for rotation with shaft 14'. Fluid exhausted from motor 80 may be discharged from housing 12' in any suitable manner. In operation, second member 42', which is resiliently deformable in response to change in the rotational speed of shaft 14', serves to vary the flow of pressurized fluid through passageway 40' for discharge through opening(s) 38' for supply to motor 80, and thereby permit control of the rotational speed of the motor, the shaft, and parts 42', 46', 48' and 50'.

Figure 7:
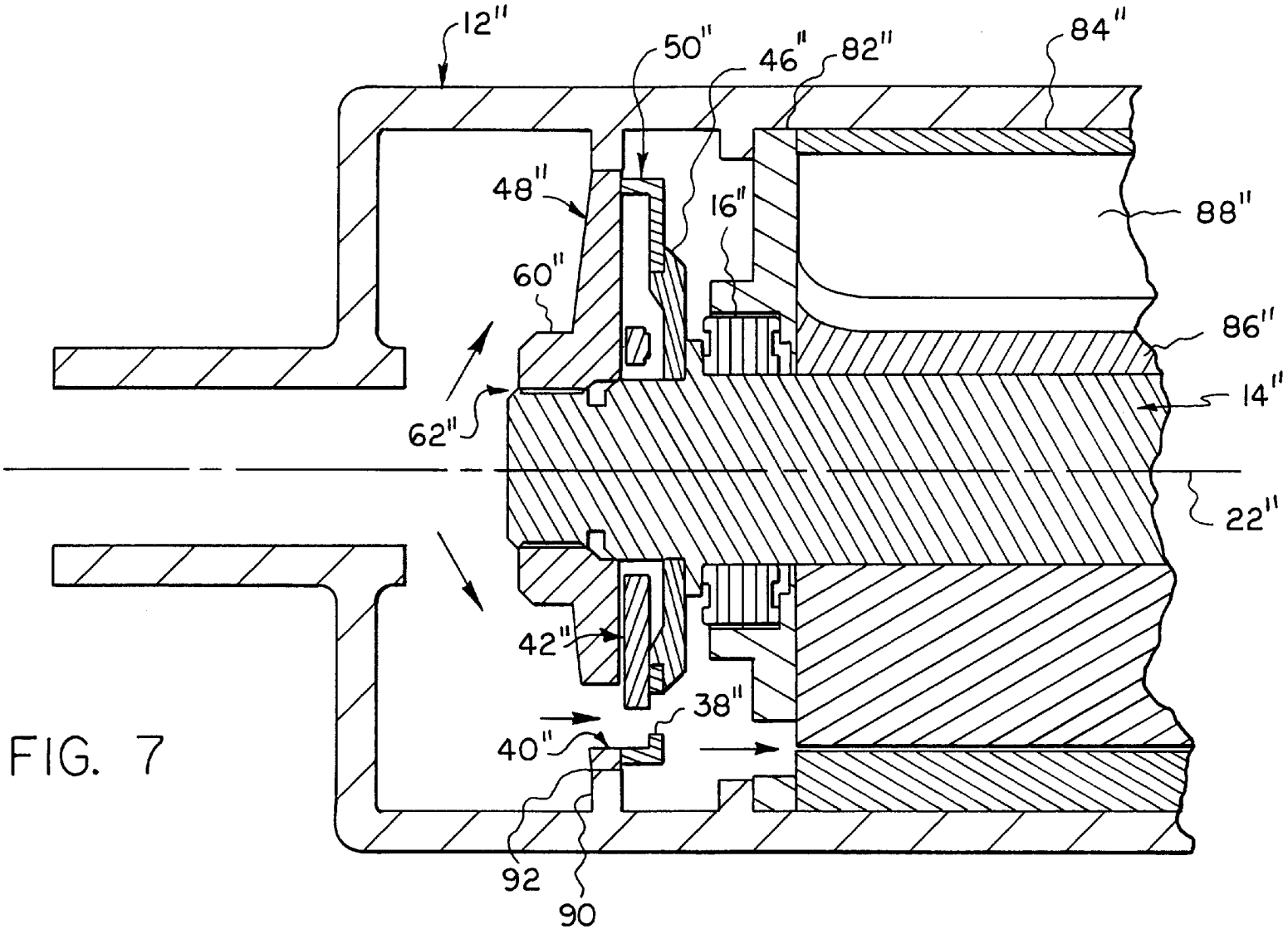
FIG. 7 is a partial sectional view taken lengthwise through a rotary device of a further alternative construction.

FIG. 7 depicts a modification of the construction shown in FIG. 6, wherein like parts are designated by like double primed numbers. More specifically, this form of the invention differs from that described in FIG. 6 primarily in that discharge opening(s) 38" are shown as opening in a direction extending generally parallel to axis 22", as opposed to tangentially of second member 42", and passageway 40" is shown as being defined solely by second part 48" and arranged to also extend generally parallel to axis 22". Pressurized fluid is suitably constrained for flow through passageway 40", such as by providing housing 12" with an internal annular sealing rim 90 sized to form a close rotational fit with the periphery of second part 48". If required, rim 90 may be provided with a suitable sealing device 92. As with the case of the previously described construction of FIG. 6, second member 42", which is resiliently deformable in response to change in rotational speed of shaft 14", serves to vary flow of pressurized fluid passing through passageway 40" for discharge through opening(s) 38" for subsequent supply to motor 80", and thereby permit control of the rotational speed of the motor.

What is claimed is:

1. A governor mechanism for controlling flow of fluid through at least one passageway in response to changes in the rotational speed of said mechanism comprising a first member supported for rotation about an axis, said first member defining at least one guide extending radially of said axis, and a second member resiliently deformable in response to said changes in rotational speed of said first member, said second member including a mounting portion carrying at least one valve portion arranged to extend radially of said axis for sliding engagement with said guide, said mounting portion being resiliently biased to remain in a first configuration in which said valve portion assumes a first radial position relative to said passageway when said first member is subject to one rotational speed and undergoing resilient deformation into a second configuration in which said valve portion assumes a second radial position relative to said passageway when said first member is subject to another rotational speed, whereby flow of fluid through said passageway varies with said radial positions of said valve portion.

2. A mechanism according to claim 1, wherein said passageway is defined by said first member and terminates in a nozzle adapted to impart rotation to said first member.

3. A mechanism according to claim 1, wherein said passageway is defined by said first member and extends generally parallel to said axis.

4. A mechanism according to claim 1, wherein a vane motor is supported for rotation with said first member on a common drive shaft and said passageway leads through said first member from a source of fluid under pressure to supply said motor with said fluid.

5. A mechanism according to claim 1, wherein said mounting portion is of ring-shaped configuration.

6. A mechanism according to claim 5, wherein said first member includes four guides spaced annularly of said axis through approximately 90° from one another, and said mounting portion includes four valve portions slidably received one by each of said guides.

7. A governor mechanism mounted on a drive shaft rotatable about an axis for controlling flow of fluid through a passageway in response to changes in rotational speed of said shaft comprising a housing fixed to said shaft and defining said passageway and a member disposed within said housing and being resiliently deformable in response to said changes in rotational speed for controlling said flow of fluid, said housing including first and second outer end parts and a third part arranged between said outer end parts and in engagement therewith, said third part defining an outlet for said passageway and at least one guide extending radially of said axis, said member including a mounting portion carrying at least one valve portion arranged to extend radially of said axis for sliding engagement with said guide, said mounting portion being biased to assume a first configuration in which said valve portion assumes a first radial position relative to said passageway when said shaft is subject to one rotational speed and undergoing resilient deformation into a second configuration in which said valve portion assumes a second radial position relative to said passageway when said shaft is subject to another rotational speed, whereby flow of fluid through said outlet varies with said radial positions of said valve portion.

8. A mechanism according to claim 7, wherein said opening is a reaction nozzle adapted to impart rotation to said shaft.

9. A mechanism according to claim 7, wherein a vane motor is supported for rotation with said housing on said shaft and said vane motor is operated by fluid passing through said opening.

10. A mechanism according to claim 9, wherein said shaft defines a flow path arranged for communication with a source of fluid under pressure, and said first, second and third parts cooperate to define said passageway extending radially between said flow path and said opening.

11. A mechanism according to claim 9, wherein said passageway extends through one of said outer end parts generally parallel to said axis.

12. A mechanism according to claim 7, wherein said third part is of a ring-shaped configuration radially positioned by a mounting member carried by one of said outer end parts and is keyed for rotation with the other of said outer end parts.

13. A mechanism according to claim 7, wherein said third part is of a ring-shaped configuration and includes at least one pair of radially aligned guides and said mounting portion is of ring-shaped configuration and carries at least one pair of radially aligned valve portions.

14. A mechanism according to claim 7, wherein each of said guides includes a radially extending guideway defined by a pair of guide ribs and each of said valve portions includes a radially inner part sliding engaging with said guide ribs and a radially outer part arranged to vary flow through said passageway to said opening.

15. A mechanism according to claim 14, wherein said shaft defines a flow path arranged for communication with a source of fluid under pressure, said passageway extends radially between said flow path and said opening, and said passageway includes an inner part defined by facing surfaces of said outer end parts and an outer part defined by facing surfaces of said third part and one of said outer end parts.

* * * * *